US010071384B2

(12) United States Patent
Kojima et al.

(10) Patent No.: US 10,071,384 B2
(45) Date of Patent: Sep. 11, 2018

(54) DUST COLLECTOR, DUST COLLECTION SYSTEM, AND DUST COLLECTION METHOD

(71) Applicant: MITSUBISHI HEAVY INDUSTRIES MECHATRONICS SYSTEMS, LTD., Kobe-shi, Hyogo (JP)

(72) Inventors: Katsuhisa Kojima, Tokyo (JP); Kazutaka Tomimatsu, Kobe (JP); Masaya Kato, Kobe (JP); Takao Tanaka, Kobe (JP)

(73) Assignee: MITSUBISHI HITACHI POWER SYSTEMS ENVIRONMENTAL SOLUTIONS, LTD., Yokohama-Shi, Kanagawa (JP)

( * ) Notice: Subject to any disclaimer, the term of this patent is extended or adjusted under 35 U.S.C. 154(b) by 89 days.

(21) Appl. No.: 14/765,753

(22) PCT Filed: Feb. 6, 2014

(86) PCT No.: PCT/JP2014/052802
§ 371 (c)(1),
(2) Date: Aug. 4, 2015

(87) PCT Pub. No.: WO2014/123202
PCT Pub. Date: Aug. 14, 2014

(65) Prior Publication Data

US 2015/0375237 A1 Dec. 31, 2015

(30) Foreign Application Priority Data

Feb. 7, 2013 (WO) ..... PCT/JP2013/052932

(51) Int. Cl.
*B03C 3/47* (2006.01)
*B03C 3/41* (2006.01)
*B03C 3/78* (2006.01)

(52) U.S. Cl.
CPC ..... *B03C 3/47* (2013.01); *B03C 3/41* (2013.01); *B03C 3/78* (2013.01); *B03C 2201/10* (2013.01)

(58) Field of Classification Search
CPC combination set(s) only.
See application file for complete search history.

(56) References Cited

U.S. PATENT DOCUMENTS 2,700,429 A * 1/1955 Wintermute ..... B03C 3/36 55/DIG. 31
5,368,635 A 11/1994 Yamamoto
(Continued)

FOREIGN PATENT DOCUMENTS

CN 2189003 Y 2/1995
CN 1394690 A 2/2003
(Continued)

OTHER PUBLICATIONS

China Patent Office, "Office Action for Chinese Patent Application No. 201480007544.9," dated Jun. 3, 2016.
(Continued)

*Primary Examiner* — Christopher P Jones
*Assistant Examiner* — Sonji Turner
(74) *Attorney, Agent, or Firm* — Manabu Kanesaka; Benjamin Hauptman; Kenneth Berner

(57) ABSTRACT

A dust collection system, a dust collection method, and a dust collector, can enhance dust-collecting efficiency while reducing the volume of the dust collector as a whole. A dust collector is provided with a casing having an inlet into which gas is introduced; a discharge electrode to which voltage is applied, the discharge electrode being disposed inside the casing and having a spike called discharge spike and mounting frames for supporting the discharge spike; and a collecting electrode having a planar member, disposed inside
(Continued)

the casing facing the discharge electrode, the mounting frames being inclined with relation to the gas flow at the inlet. Two mounting frames are connected to each other on the downstream side of the gas flow, and are arranged so that, between the two mounting frames, the upstream side of the gas flow is wider than the downstream side of the gas flow.

9 Claims, 17 Drawing Sheets

(56) References Cited

U.S. PATENT DOCUMENTS

| | | | | | |
|---|---|---|---|---|---|
| 5,403,383 | A | * | 4/1995 | Jaisinghani | B03C 3/155 422/22 |
| 5,466,279 | A | * | 11/1995 | Hattori | B03C 3/12 29/25.01 |
| 5,549,735 | A | | 8/1996 | Coppom | |
| 5,593,476 | A | * | 1/1997 | Coppom | B03C 3/155 95/78 |
| 7,763,101 | B2 | | 7/2010 | Maekawa et al. | |
| 2002/0170435 | A1 | * | 11/2002 | Joannou | B03C 3/155 96/66 |
| 2004/0139854 | A1 | | 7/2004 | Rittri et al. | |
| 2007/0000236 | A1 | | 1/2007 | Naito et al. | |
| 2011/0171094 | A1 | * | 7/2011 | Zahedi | B01D 53/323 423/245.1 |

FOREIGN PATENT DOCUMENTS

| | | | | |
|---|---|---|---|---|
| CN | 101396677 | A | | 4/2009 |
| GB | 1306388 | | | 2/1973 |
| JP | S47-770 | U | | 8/1972 |
| JP | S53-10179 | A | | 1/1978 |
| JP | S55-3885 | A | | 1/1980 |
| JP | S55-15663 | A | | 2/1980 |
| JP | S58-107151 | U | | 7/1983 |
| JP | S61-15750 | A | | 1/1986 |
| JP | 363120139 | | * | 5/1988 |
| JP | H04-059062 | A | | 2/1992 |
| JP | H07-501745 | A | | 2/1995 |
| JP | H07-265730 | A | | 10/1995 |
| JP | H09-141126 | A | | 6/1997 |
| JP | H10-244832 | A | | 9/1998 |
| JP | 2002-361117 | A | | 12/2002 |
| JP | 2004-167453 | A | | 6/2004 |
| JP | 2007-117968 | A | | 5/2007 |
| JP | 2008-212846 | A | | 9/2008 |
| JP | 2009-131795 | A | | 6/2009 |

OTHER PUBLICATIONS

Japan Patent Office, "Decision of Rejection for Japanese Patent Application No. 2014-560807," dated Aug. 2, 2016.

Europe Patent Office, "Partial Supplementary Search Report for European Patent Application No. 14749331.6" dated Aug. 25, 2016.

PCT/ISA/210, "International Search Report for PCT/JP2013/052932".

PCT/ISA/237, "Written Opinion of the International Searching Authority for PCT/JP2013/052932".

PCT/ISA/210, "International Search Report for PCT/JP2014/052802".

PCT/ISA/237, "Written Opinion of the International Searching Authority for PCT/JP2014/052802".

Japan Patent Office, "Office Action for Japanese Patent Application No. 2014-560807," dated Dec. 15, 2015.

China Patent Office, "Office Action for Chinese Patent Application No. 201480007544.9," dated Jan. 26, 2017.

* cited by examiner

DUST COLLECTOR, DUST COLLECTION SYSTEM, AND DUST COLLECTION METHOD

RELATED APPLICATIONS

The present application is National Phase of International Application No. PCT/JP2014/052802 filed Feb. 6, 2014, and claims priority from PCT Application No. PCT/JP2013/052932 filed Feb. 7, 2013, the disclosure of which is hereby incorporated by reference herein in its entirety.

TECHNICAL FIELD

The present invention relates to a dust collector, a dust collection system, and a dust collection method.

BACKGROUND ART

Exhaust gas containing dust (particulate material, for example), SOx, and the like is generated due to combustion at industrial combustion facilities such as coal- or heavy oil-fired power generation plants, incinerators, and the like. An exhaust gas treatment facility is installed in a flue located on the downstream side of such a combustion facility in order to discharge the exhaust gas to the atmosphere after removing the dust, SOx, and the like from the exhaust gas.

A wet-type desulfurization equipment, a dust collector, or the like is provided in the exhaust gas treatment facility. The wet-type desulfurization equipment uses magnesium hydroxide ($Mg(OH)_2$) as adsorbing material, for example, and supplies the adsorbing material to the exhaust gas using a spray. As a result of the SOx being adsorbed by the adsorbing material, the SOx is removed from the exhaust gas.

In order to remove dust or mist, the dust collector includes a discharge electrode that causes particulate material to be electrically charged and a collecting electrode that is disposed facing the discharge electrode. As a result of corona discharge being generated by the discharge electrode, the particulate material contained in the exhaust gas is ionized. Then, the ionized particulate material is collected by the collecting electrode.

Patent Literature 1 discloses, in order to reliably collect the particulate material, a technology in which an ion wind is used to accelerate the particulate material in a direction perpendicular to a gas flow inside a casing, and then, the particulate material is collected by a collecting electrode that has a predetermined opening ratio that allows the ion wind to penetrate.

CITATION LIST

Patent Literature

Patent Literature 1: Japanese Unexamined Patent Application Publication No. 2007-117968A

SUMMARY OF INVENTION

Technical Problem

The dust collector requires a structure that supports the discharge electrode and the collecting electrode. Thus, the structure may be large-scaled, and the volume of the dust collector as a whole becomes large. Moreover, the flow velocity is increased and the drift occurs in the gas inflow portion of the dust collector, which is reduced the dust-collecting efficiency.

Moreover, the collecting electrode is washed in water to restore the pressure differential increased by clogging due to dust and to prevent corrosion caused by attached sulfuric acid mist having corrosive properties. When a wire mesh having a predetermined opening ratio is used for the collecting electrode of the dust collector and water is sprayed using a spray nozzle, droplets exist between the discharge electrode and the collecting electrode. As a result, spark occurs, and the operation voltage is reduced, causing reduction of dust-collecting efficiency.

When water is made flow from the upper portion of the collecting electrode so that a liquid film is formed on an electrode surface of the collecting electrode, the collecting electrode can be washed without causing droplets existing in discharge space. However, when the collecting electrode has a predetermined opening ratio such as that of a wire mesh, a liquid film is not formed, but water flows linearly along wires of the wire mesh. Therefore, when water is made flow onto a wire mesh, it is difficult to form a liquid film equally on the electrode surface as compared with an example in which the collecting electrode is a flat plate, thus causing corrosion of the collecting electrode.

The present invention is made in light of the foregoing, and an object of the present invention is to provide a dust collector, a dust collection system, and a dust collection method that are capable of enhancing dust-collecting efficiency while reducing the volume of the dust collector as a whole.

Solution to Problem

A dust collector according to the present invention includes a casing having an inlet portion into which gas is introduced; a discharge electrode disposed inside the casing, the discharge electrode having a spike called discharge spike and a mounting frame for supporting the discharge spike and being configured to have voltage applied thereto; and a collecting electrode disposed inside the casing so as to face the discharge electrode, the collecting electrode having a planar member. In such a dust collector, the mounting frame is inclined with respect to a gas flow at the inlet portion, and the two mounting frames are connected to each other on the downstream side of the gas flow, and are disposed so that, between the two mounting frames, the upstream side of the gas flow is wider than the downstream side of the gas flow.

According to this configuration, when the exhaust gas containing the particulate material, for example, is introduced from the inlet portion of the casing, as a result of the corona discharge being generated by the discharge electrode, the particulate material contained in the exhaust gas is ionized, and the ionized particulate material is collected by the collecting electrode. Furthermore, the two mounting frames of the discharge electrode are connected to each other on the downstream side of the gas flow, and are disposed so that the upstream side of the gas flow is wider than the downstream side of the gas flow. Thus, when the connection portion of the mounting frames is provided on the upper portions thereof, the discharge electrode can self-stand, being supported only from below and there is no need to support the discharge electrode on the upper side thereof. By contrast, when the connection portion of the mounting frames is provided on the lower portions thereof, the mounting frames are connected to each other and the cross-section shape is maintained. Thus, there is no need to support the discharge electrode on the lower side thereof. Moreover, as the discharge electrode is inclined with respect to the flow direction of the gas flow and the upstream side of the gas flow is wider, it is possible to suppress an increase of the flow velocity in the gas inflow portion and to suppress the occurrence of drift. Here, the planar member of the collecting electrode is a member, such as a metal mesh or a punching metal, having an opening and having conductivity.

In the above-described invention, the planar member of the collecting electrode may be inclined with respect to the gas flow at the inlet portion, and the two collecting electrodes are connected to each other on the downstream side of the gas flow, and are disposed so that the upstream side of the gas flow is wider than the downstream side of the gas flow.

According to this configuration, as the planar member of the collecting electrode is inclined with respect to the gas flow at the inlet portion, the ionized particulate material reliably penetrates the collecting electrode, regardless of being on the upstream side or the downstream side of the gas flow.

The two collecting electrodes are connected to each other on the downstream side of the gas flow, and are disposed so that the upstream side of the gas flow is wider than the downstream side of the gas flow, which can simplify or omit a structure for supporting the collecting electrode.

In the above-described invention, the dust collector may further include a plurality of water spraying units provided along the planar member of the collecting electrode, the water spraying units being configured to spray water, and a running water board provided in the periphery of the water spraying unit along the planar member, the running water board being configured to receive the water sprayed from the water spraying unit and to allow the water to flow toward the planar member.

According to this configuration, water sprayed from a plurality of water spraying units hits the running water board to be diffused, and then flows toward the planar member of the collecting electrode. Therefore, as compared with the case in which water is sprayed directly from the water spraying unit toward the planar member of the collecting electrode, water can be made flow equally onto the surface of the planar member of the collecting electrode to form a liquid film, thus preventing corrosion of the collecting electrode.

Note that the end portion of a flat plate on the planar member side may be machined to bend upward or downward. This enables water to flow more equally toward the planar member of the collecting electrode. Moreover, the direction of water sprayed from the water spraying unit is an upper, lower, or a horizontal direction, and the number of rows of holes provided on the water spraying unit is one or more.

In the above-described invention, the dust collector may further include a filter material disposed on a surface side of the collecting electrode opposite to a surface of the collecting electrode facing the discharge electrode.

According to this configuration, as a result of the filter material being further provided, the overall dust-collecting efficiency can be enhanced.

In the above-described invention, the dust collector may further include an electric field forming electrode disposed separated from the filter material on a surface side of the filter material opposite to a surface of the filter material having the collecting electrode provided thereon.

According to this configuration, as a result of the electric field forming electrode being further provided, an electric field is formed in the filter material, and the charged particulate material is collected by electrostatic force; thus the overall dust-collecting efficiency can be enhanced.

In the above-described invention, the discharge electrode may be disposed on the both surface sides of the collecting electrode.

According to this configuration, as discharge space is formed on the both surface sides of the collecting electrode, the dust-collecting efficiency can be enhanced.

A dust collection system according to the present invention includes a plurality of stages of the above-described dust collectors disposed in series along a gas flow.

According to this configuration, as a plurality of stages of the dust collectors is disposed in series along a gas flow, the dust-collecting efficiency can be enhanced.

A dust collector according to the present invention includes a discharge electrode configured to have voltage applied thereto, a collecting electrode disposed facing the discharge electrode, having a planar member formed of a wire mesh, a plurality of water spraying units provided along the planar member of the collecting electrode, the water spraying units being configured to spray water, and a running water board provided in the periphery of the water spraying unit along the planar member, the running water board being configured to receive the water sprayed from the water spraying unit and to allow the water to flow toward the planar member.

A dust collection method according to the present invention is to collect particulate material using a dust collector. The dust collector includes a casing having an inlet portion into which gas is introduced; a discharge electrode disposed inside the casing, the discharge electrode having a spike called discharge spike and a mounting frame for supporting the discharge spike and being configured to have voltage applied thereto; and a collecting electrode disposed inside the casing so as to face the discharge electrode, the collecting electrode having a planar member. The mounting frame is inclined with respect to a gas flow at the inlet portion, and the two mounting frames support the load of each other on the downstream side of the gas flow, and are disposed so that, between the two mounting frames, the upstream side of the gas flow is wider than the downstream side of the gas flow.

Advantageous Effect of Invention

According to the present invention, it is possible to enhance dust-collecting efficiency while reducing the volume of the apparatus as a whole.

DESCRIPTION OF EMBODIMENTS

Figure 1:
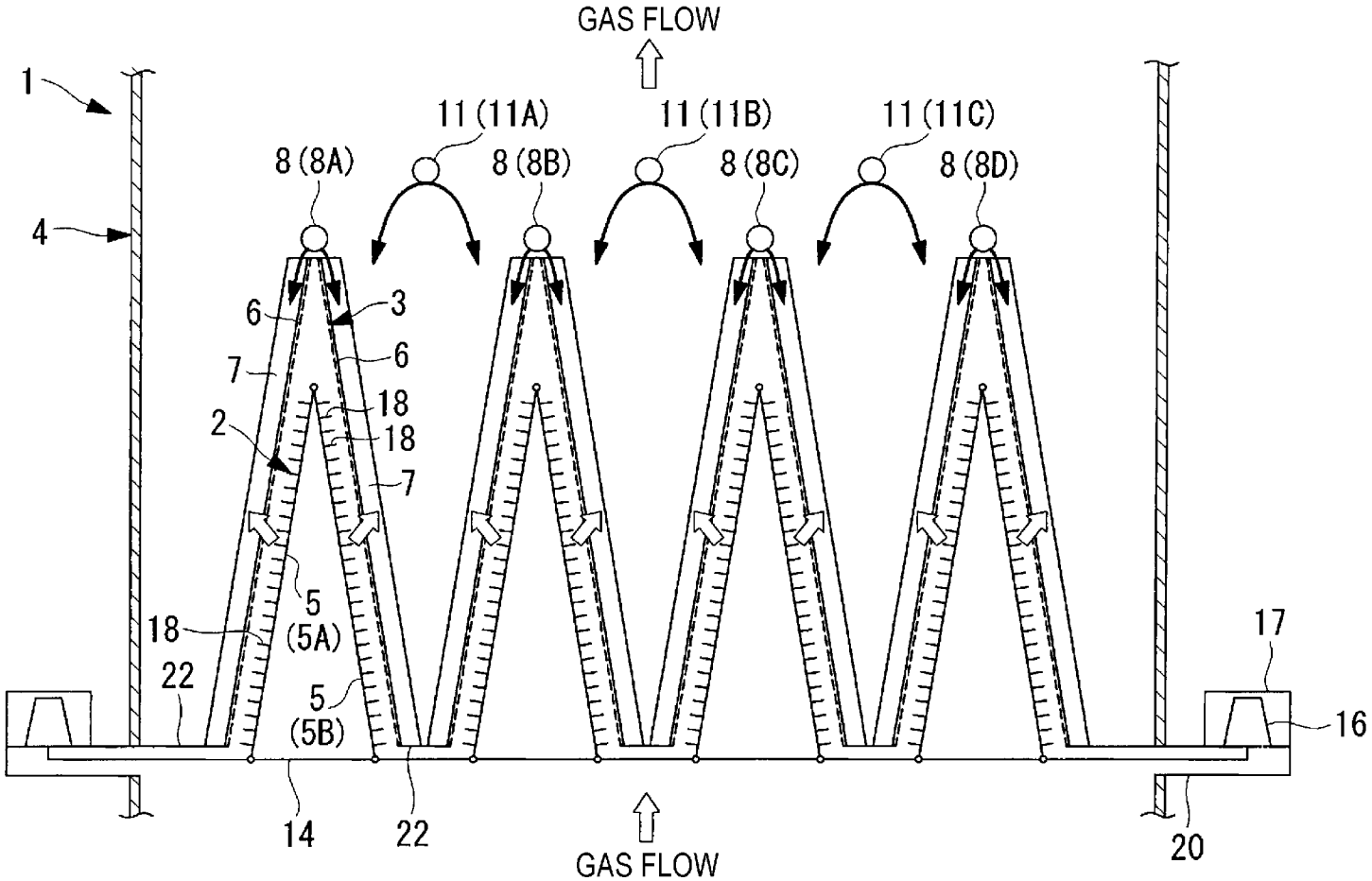
FIG. 1 is a vertical cross-sectional view illustrating a dust collector according to an embodiment of the present invention.

A configuration of a dust collector 1 according to an embodiment of the present invention will be described below with reference to FIG. 1 and FIG. 2.

The dust collector 1 according to the present embodiment is, for example, installed in an exhaust gas treatment facility, which is provided inside a flue located on the downstream side of an industrial combustion facility such as a coal- or heavy oil-fired power generation plant or an incinerator. Moreover, the dust collector 1 can be also used for a filter for air cleaning facilities (an air conditioning filter for a clean room, a filter for removing a virus, and the like, for example), and the like as well as for the industrial combustion facilities.

The dust collector 1 includes a discharge electrode 2 that causes particulate material to be electrically charged and a collecting electrode 3 that is disposed facing the discharge electrode 2 in order to remove the particulate material, such as dust and mist. The discharge electrode 2 and the collecting electrode 3 are disposed inside a casing 4.

The discharge electrode 2 has a mounting frame 5 and a discharge spike 18. The discharge spike 18 is disposed on the mounting frame 5 so as to form a spiny shape from the mounting frame 5 toward the collecting electrode 3.

The mounting frame 5 is a linear member and is inclined with respect to the gas flow at the inlet portion. An upstream side of the gas flow in the dust collector 1 is positioned on a lower side in the gravity direction and a downstream side of the gas flow is positioned on an upper side in the gravity direction. The mounting frame 5 is formed of two mounting frames 5A and 5B combined with each other and self-stands on an electrode support member 14. More specifically, the two mounting frames 5A and 5B support the load of each other on the downstream side of the gas flow. The two mounting frames 5A and 5B are disposed so that the upstream side of the gas flow is wider than the downstream side of the gas flow. The two mounting frames 5A and 5B are disposed with the gap therebetween widened on the upstream side of the gas flow so that a space velocity becomes from 1 m/s to 4 m/s, for example. In an example illustrated in FIG. 1 and FIG. 2, a shape formed by the plurality of mounting frames 5A and 5B combined with each other is a triangular prism. A bottom portion of the triangular prism on the upstream side of the gas flow is opened, and the mounting frames 5A and 5B are provided on side surfaces of the triangular prism.

The collecting electrode 3 has a planar member 6 formed of a wire mesh or the like, and is disposed facing the discharge electrode 2. The planar member 6 of the collecting electrode 3 is a member having an opening and having conductivity, and is a wire mesh or a punching metal, for example.

In the collecting electrode 3, the planar member 6 is inclined with respect to the gas flow at the inlet portion. The collecting electrode 3 is formed of two planar members 6 combined with each other and self-stands on the support member. The two sheets of the planar members 6 support the load of each other on the downstream side of the gas flow. The two sheets of the planar members 6 are disposed so that the upstream side of the gas flow is wider than the downstream side of the gas flow.

Although the collecting electrode 3 is positioned above the discharge electrode 2 so as to cover the discharge electrode 2, the discharge electrode 2 and the collecting electrode 3 are separated and electrically insulated from each other.

The electrode support member 14 penetrates the casing 4 and is connected to an insulator 16 housed in an insulator room 17. In order to avoid leak of gas flowing in the casing 4, the electrode support member 14 is covered by a cylindrical member 20, for example, in the outside of the casing 4, and the end portion of the cylindrical member 20 is closed by the insulator room 17.

The discharge electrode 2 is connected to a high voltage power supply (not illustrated) via the insulator 16 fixed to the casing 4 and the electrode support member 14. As a result of the high voltage being applied to the discharge electrode 2, corona discharge is generated by the discharge electrode 2. The corona discharge causes the particulate material contained in the exhaust gas to be ionized. Then, the ionized particulate material is collected by the collecting electrode 3.

Figure 2:
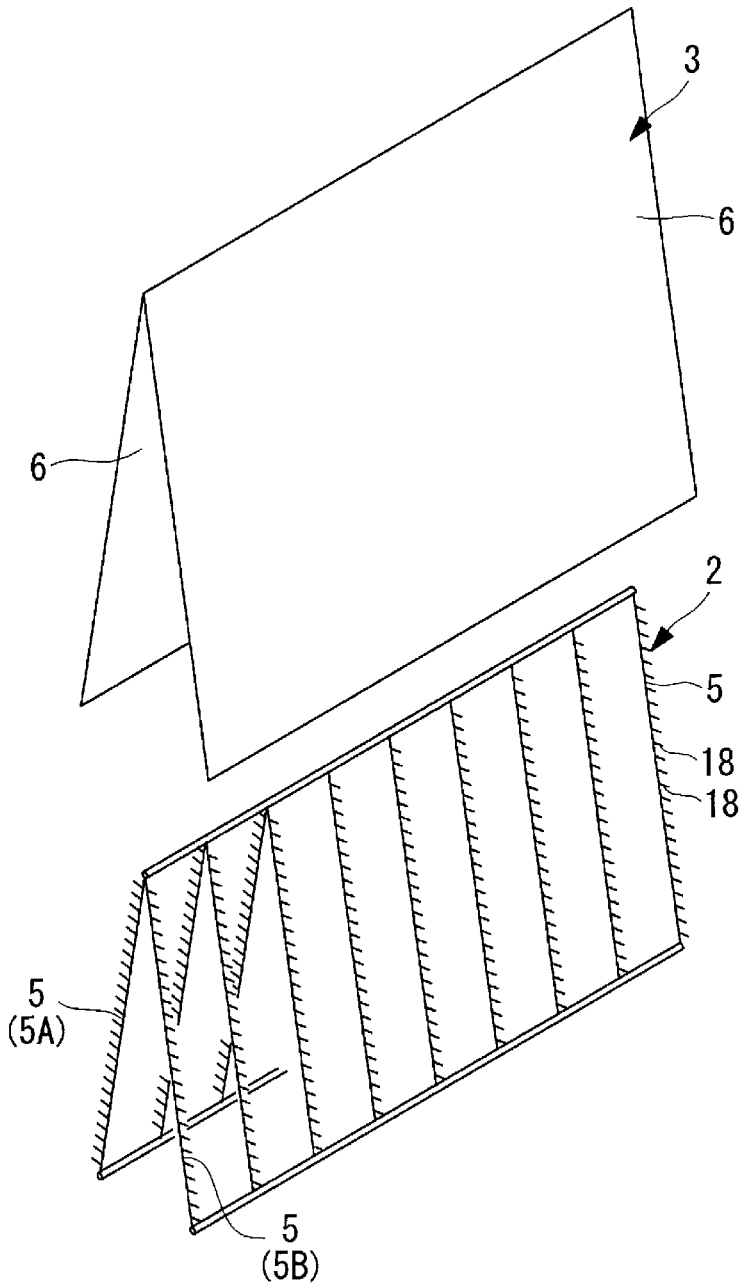
FIG. 2 is an exploded perspective view illustrating a discharge electrode and a collecting electrode according to the embodiment of the present invention.

Although FIG. 1 illustrates an example in which a filter material 7 is provided in the dust collector 1, only the collecting electrode 3 may be disposed without the filter material 7. However, it is desirable that the dust collector 1 further include the filter material 7 disposed on a surface side of the collecting electrode 3 opposite to a surface of collecting electrode 3 facing the discharge electrode 2 as illustrated in FIG. 1. The filter material 7 is a middle efficiency particulate air filter or the like, for example. As a result of the filter material 7 being further provided, it is possible to enhance the overall dust-collecting efficiency of the dust collector 1. Note that it is desirable that the filter material 7 have a specification that provides a finer mesh than that of the wire mesh. A material property of the filter material 7 is not particularly limited.

According to the present embodiment, when the exhaust gas containing the particulate material, for example, is introduced from the inlet portion of the casing 4, as a result of the corona discharge being generated by the discharge electrode 2, the particulate material contained in the exhaust gas is ionized, and the ionized particulate material is collected by the collecting electrode 3. Furthermore, as the two mounting frames 5 of the discharge electrode 2 support the load of each other on the downstream side of the gas flow and the two mounting frames 5 are disposed so that the upstream side of the gas flow is wider than the downstream side of the gas flow, the discharge electrode 2 can self-stand, being supported only from below and there is no need to support the discharge electrode 2 on an upper side thereof. Moreover, as the mounting frames 5 are inclined with respect to the flow direction of the gas flow and the upstream side of the gas flow is wider, it is possible to suppress an increase of the flow velocity in the gas inflow portion.

According to the present embodiment, as the planar member 6 of the collecting electrode 3 is inclined with respect to the gas flow of the inlet portion, the ionized particulate material reliably penetrates the collecting electrode 3, regardless of being on the upstream side or the downstream side of the gas flow.

As the two sheets of the planar members 6 of the collecting electrode 3 support the load of each other on the downstream side of the gas flow and the two sheets of the planar members 6 are disposed so that the upstream side of the gas flow is wider than the downstream side of the gas flow, the planar members 6 can self-stand, being supported only from below, and there is no need to support the planar members 6 on an upper side thereof. Moreover, as the planar members 6 are inclined with respect to the flow direction of the gas flow and the upstream side of the gas flow is wider, it is possible to suppress an increase of the flow velocity in the gas inflow portion.

Note that, at the end portion of the collecting electrode 3 on the upstream side of the gas flow, a planar member 22 connects the collecting electrode 3 and the casing 4, and/or planar member 22 connects the collecting electrodes 3 adjacent to each other. Accordingly, the gap between the collecting electrode 3 and the casing 4 and/or the gap between the collecting electrodes adjacent to each other is closed by the planar member 22, and the gas flow in the casing 4 passes between the two planar members 6 combined with each other on the downstream side of the gas flow, thus preventing gas from flowing into other portions.

Note that, although the case has been described in the above-described embodiment in which a shape in the vertical cross section of the mounting frame 5 of the discharge electrode 2 and a shape in the vertical cross section of the planar member 6 of the collecting electrode 3 are triangular, the present invention is not limited to this example. The shape in the vertical cross section of the mounting frame 5 of the discharge electrode 2 and the shape in the vertical cross section of the planar member 6 of the collecting electrode 3 may be polygonal (trapezoidal, pentagonal, or the like, for example) other than triangular, for example.

Figure 3:
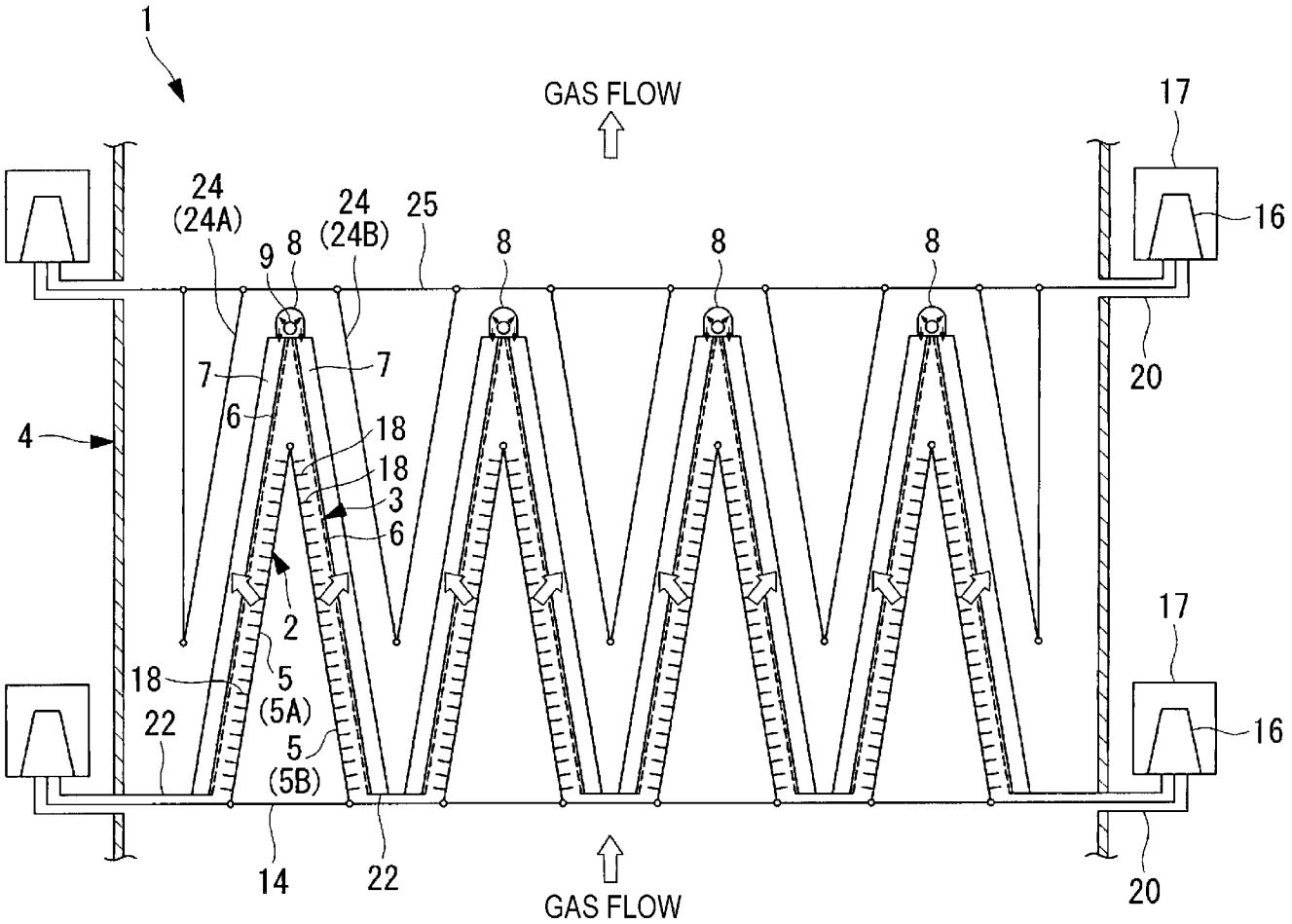
FIG. 3 is a vertical cross-sectional view illustrating a first modified example of the dust collector according to the embodiment of the present invention.

Next, a first modified example of the dust collector 1 according to the present embodiment will be described with reference to FIG. 3.

In the above-described embodiment, the example has been described in which other electrodes and the like are not disposed on the downstream side of the gas flow relative to the filter material 7. In the present modified example, an electric field forming electrode 24 is disposed on a surface opposite to the surface having the collecting electrode 3 disposed thereon with respect to the filter material 7. The electric field forming electrode 24 is disposed separate from the filter material 7, and voltage is applied to the electric field forming electrode 24. Note that as the power supply of the electric field forming electrode 24, the same power supply for the discharge electrode 2 may be used.

The electric field forming electrode 24 is a linear member similar to the mounting frame 5 of the discharge electrode 2. The electric field forming electrode 24 does not have a spike called discharge spike, unlike the discharge electrode 2. The electric field forming electrode 24 faces the filter material 7 and is inclined with respect to the gas flow at the inlet portion. The electric field forming electrode 24 is formed of two frames 24A and 24B combined with each other and is hung from an electrode support member 25. That is, the two frames 24A and 24B are connected to each other on the upstream side of the gas flow, and connected to the electrode support member 25 on the downstream side of the gas flow.

In the present modified example, voltage is applied to the electric field forming electrode 24, whereby an electric field is formed in the filter material 7. Thus, the charged particulate material is collected efficiently by the filter material 7 with electrostatic force. On the other hand, when the power supply of the electric field forming electrode 24 is off or when the electric field forming electrode 24 is not provided, electrostatic force is applied to the filter material 7 by mirror image charge caused by the charged particulate material. However, such force is small as compared with the case in which voltage is applied to the electric field forming electrode 24. Therefore, according to the present modified example, it is possible to enhance dust-collecting efficiency of the dust collector 1. Note that, when the electric field forming electrode 24 is provided in this manner, a material property of the filter material 7 is preferably non-conductive.

Figure 4:
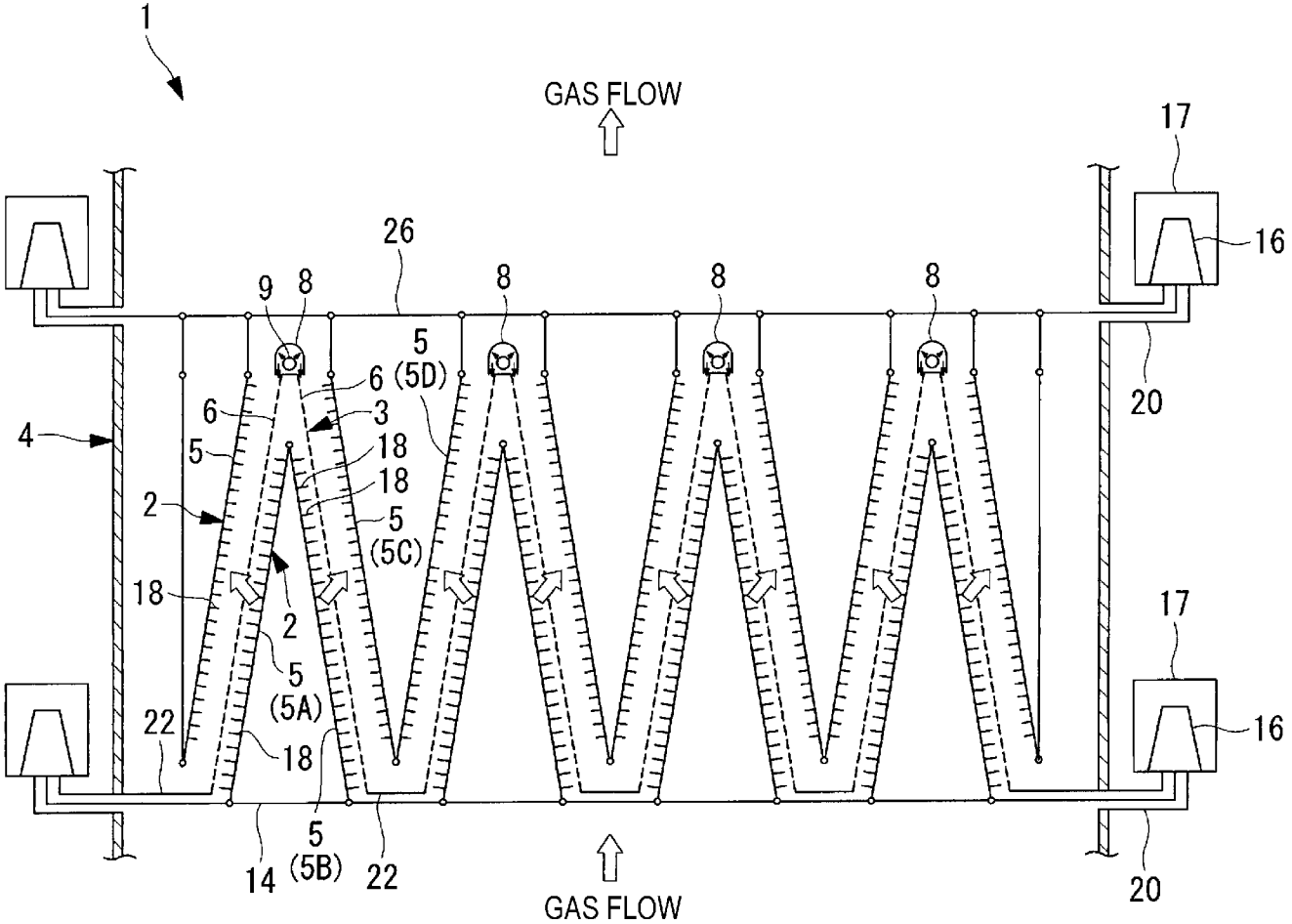
FIG. 4 is a vertical cross-sectional view illustrating a second modified example of the dust collector according to the embodiment of the present invention.

Moreover, although in the above-described embodiment, the case has been described in which the discharge electrode 2 is disposed on only the lower side of the collecting electrode 3, the present invention is not limited to this example. For example, as illustrated in FIG. 4, when the filter material 7 is not disposed, the discharge electrode 2 may be disposed on the both sides including the upper side and the lower side of the collecting electrode 3. The discharge electrode 2 disposed on the upper side of the collecting electrode 3 also has the mounting frame 5 and the discharge spike 18, similarly to the above-described discharge electrode 2 disposed on the lower side of the collecting electrode 3. The discharge electrode 2 disposed on the upper side is formed of two mounting frames 5C and 5D combined with each other and is hung from an electrode support member 26. That is, the two mounting frames 5C and 5D are connected to each other on the upstream side of the gas flow. When the discharge electrode 2 is disposed on the both sides of the collecting electrode 3, discharge space is formed on the both sides of the collecting electrode 3, thus enhancing dust-collecting efficiency.

Moreover, only one stage of dust collector 1 according to the present embodiment may be disposed in the exhaust gas treatment facility, or a plurality of stages of the dust collectors 1 may be disposed in series along the gas flow. In the dust collection system in which a plurality of stages of dust collectors 1 is disposed, such a plurality of stages of dust collectors 1 is disposed in series along the gas flow, thus enhancing dust-collecting efficiency.

Figure 5:
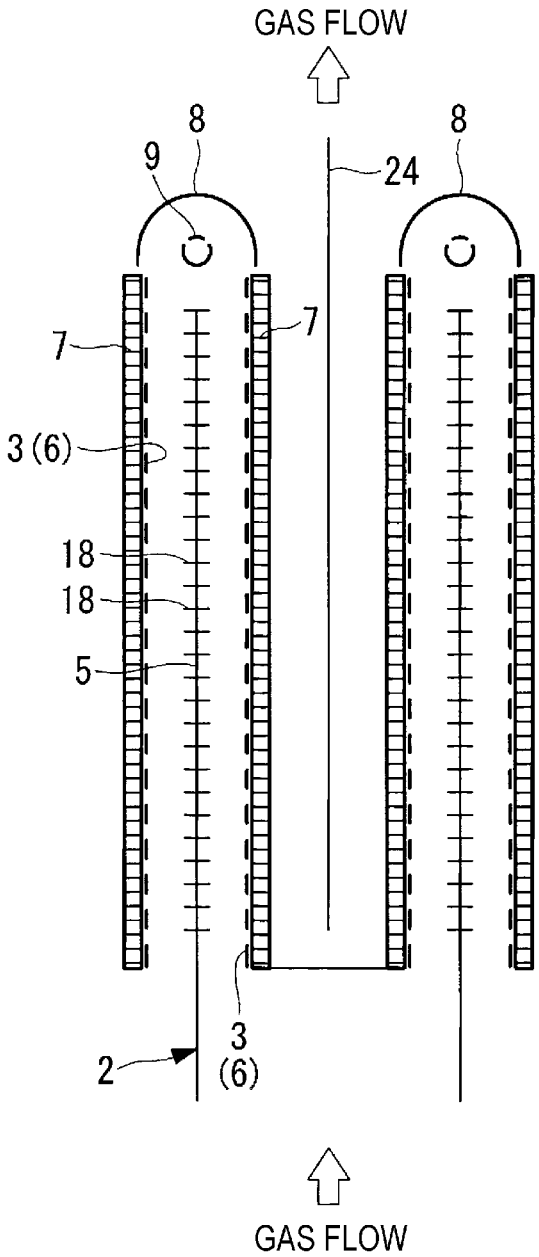
FIG. 5 is a vertical cross-sectional view illustrating a third modified example of the dust collector according to the embodiment of the present invention.
Figure 6:
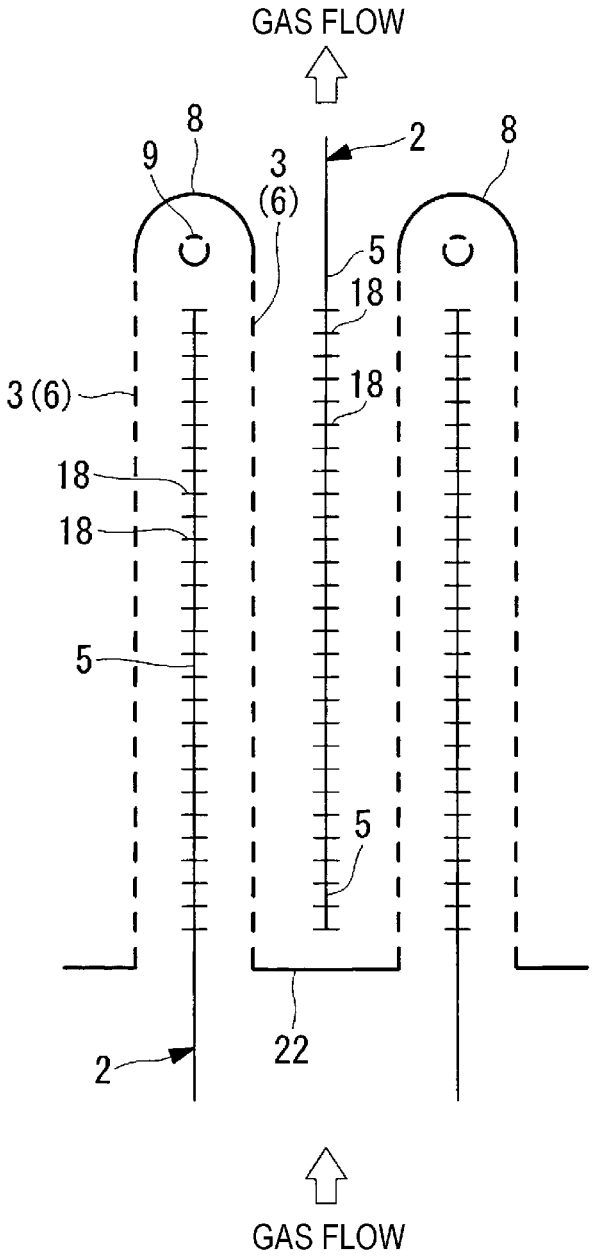
FIG. 6 is a vertical cross-sectional view illustrating a fourth modified example of the dust collector according to the embodiment of the present invention.

Furthermore, in the dust collector 1 according to the present embodiment, the configurations of the discharge electrode 2 and the collecting electrode 3 are not limited to the forms described above. That is, the discharge electrode 2 and the collecting electrode 3 do not have to be inclined with respect to the gas flow direction, but may be disposed in parallel with the gas flow direction, as illustrated in FIG. 5 and FIG. 6. Then, as illustrated in FIG. 5, the filter material 7 may be provided and the electric field forming electrode 24 may be provided on the downstream side of the gas flow relative to the collecting electrode 3. As illustrated in FIG. 6, the discharge electrode 2 may be disposed on the downstream side of the gas flow relative to the collecting electrode 3.

Note that, although the example has been described in the embodiment illustrated in FIG. 1 in which the mounting frame 5 and the planar member 6 self-stand in the vertical direction with respect to an installation surface of the dust collector 1, the present invention is not limited to this example. For example, the longitudinal direction of the mounting frame 5 and the planar member 6 may be disposed in a direction parallel to the installation surface of the dust collector 1, that is, in the horizontal direction, and the mounting frame 5 and the planar member 6 may be fixed to the support member in the cantilever manner. Here, the gas flow in the casing 4 is a horizontal flow.

Figure 7:
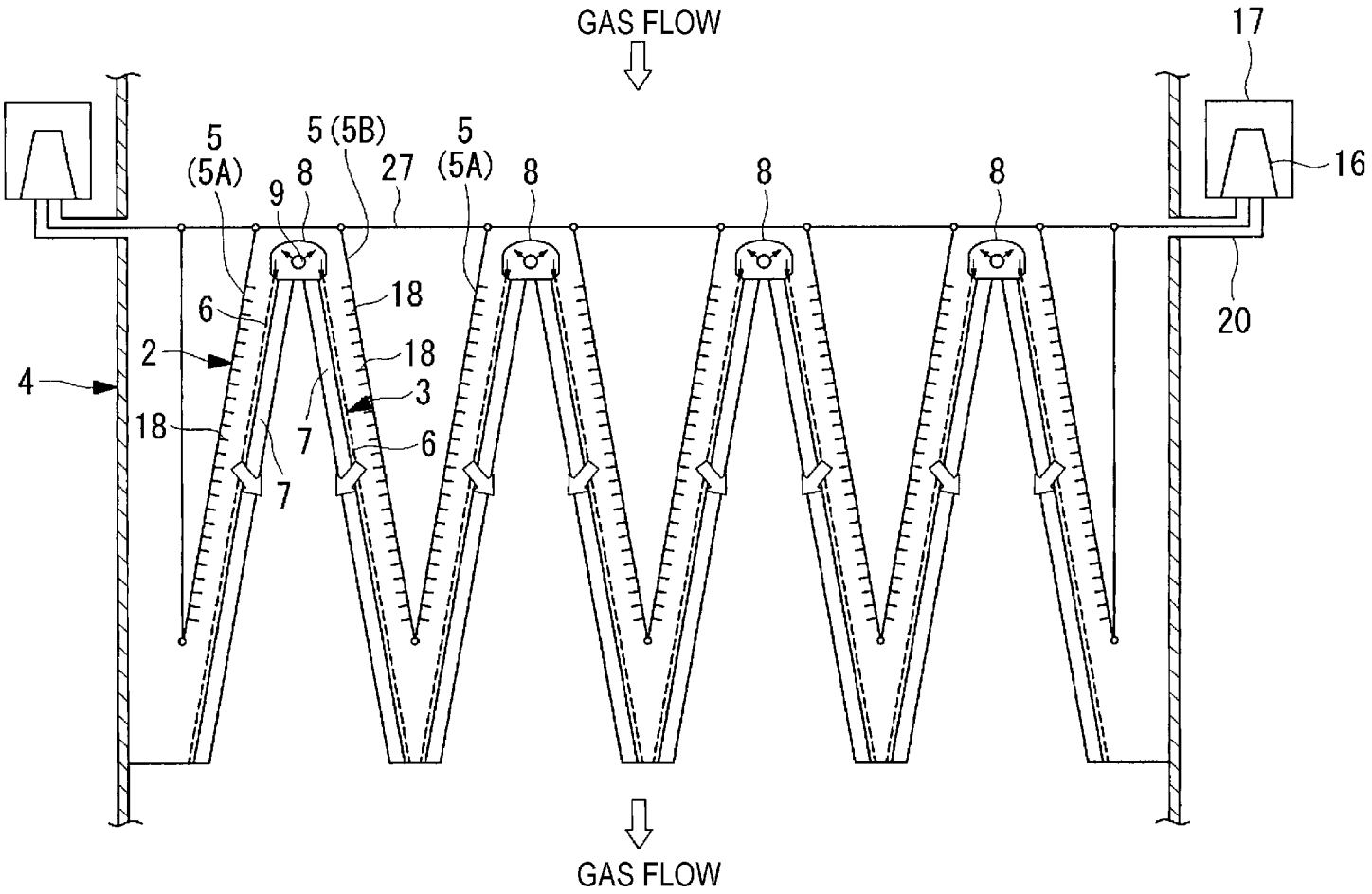
FIG. 7 is a vertical cross-sectional view illustrating a fifth modified example of the dust collector according to the embodiment of the present invention.

Moreover, as illustrated in FIG. 7, the upstream side of the gas flow in the dust collector 1 may be positioned on the upper side in the gravity direction and the downstream side of the gas flow may be positioned on the lower side in the gravity direction. Here, the mounting frame 5 is formed of two mounting frames 5A and 5B combined with each other and is hung from an electrode support member 27. The mounting frame 5 is disposed so that the upstream side of the gas flow is wider than the downstream side of the gas flow. That is, the two mounting frames 5A and 5B are connected to each other on the downstream side of the gas flow, and the cross-sectional shape is maintained, whereby there is no need to support the mounting frames 5A and 5B on the lower side thereof. Moreover, the two planar members 6 of the collecting electrode 3 are connected to each other on the downstream side of the gas flow, and there is no need to support the planar members 6 on the lower side thereof.

Note that the filter material 7 illustrated in FIG. 7 is provided, on the back side thereof, with a support member such as a wire mesh to avoid falling. Moreover, in FIG. 7, the example in which the filter material 7 is provided has been described. However, the present modified example can be further applied to the example in which the electric field forming electrode 24 is disposed, the example in which the filter material 7 is not disposed and only the collecting electrode 3 is disposed, or the example in which the filter material 7 is not disposed and the discharge electrode 2 is further disposed on the back side of the collecting electrode 3, which have been described above.

[Water Washing Unit]

Next, a water washing unit 8 of the dust collector 1 according to the embodiment of the present invention will be described with reference to FIG. 8 to FIG. 13.

Figure 8:
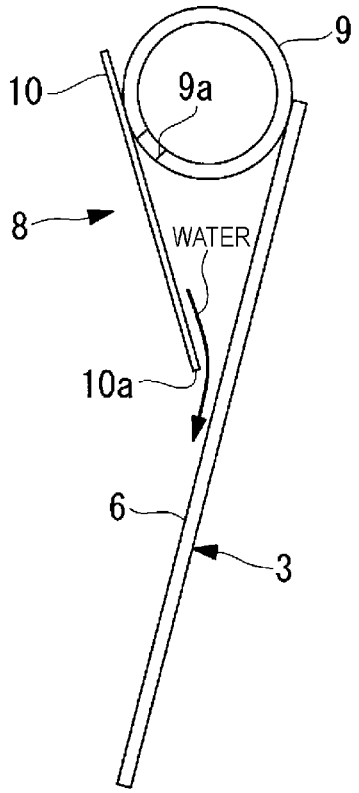
FIG. 8 is a vertical cross-sectional view illustrating a water washing unit of the dust collector according to the embodiment of the present invention.
Figure 9:
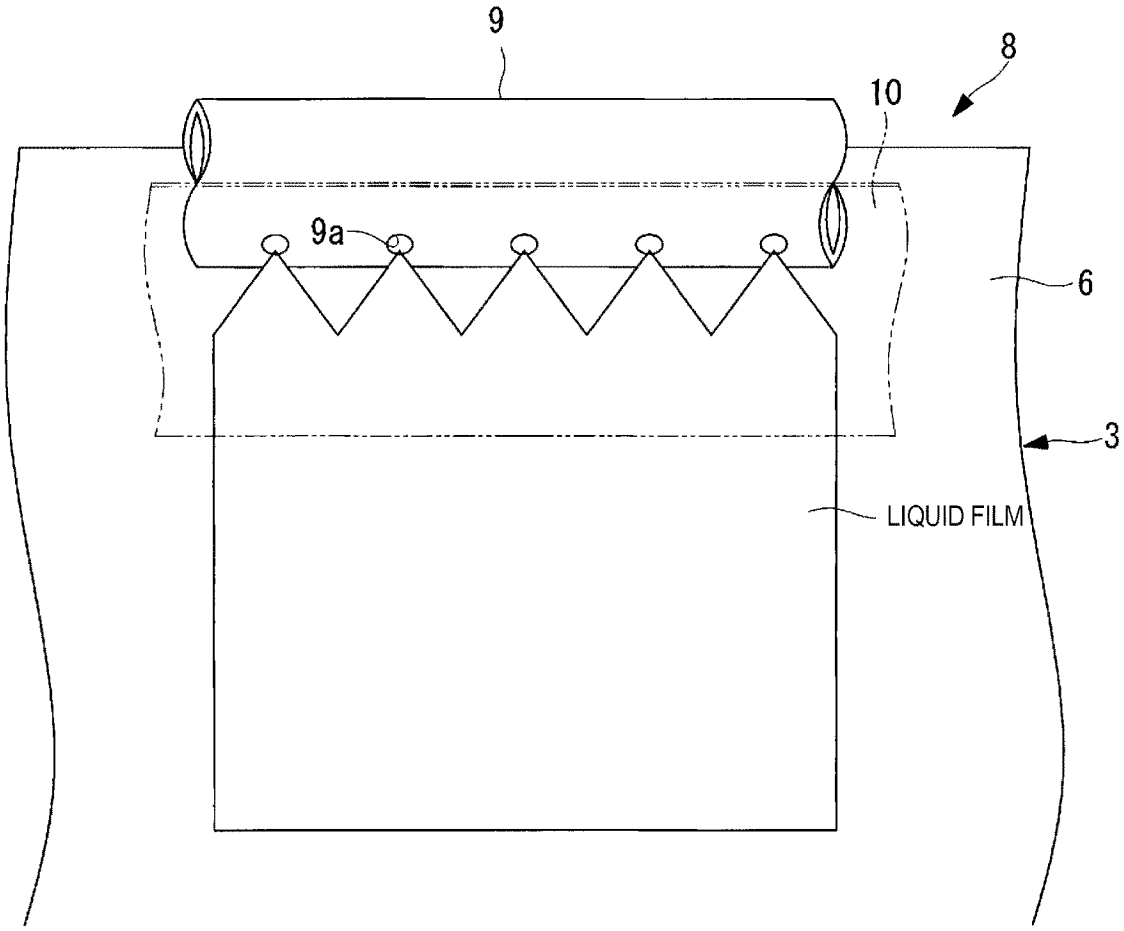
FIG. 9 is a front view illustrating the water washing unit of the dust collector according to the embodiment of the present invention.

As illustrated in FIG. 8 and FIG. 9, the water washing unit 8 includes a water spraying unit 9 that is provided along the planar member 6 of the collecting electrode 3 and has a plurality of holes 9*a* through which water is sprayed downward, and a flat plate 10 that is provided on the lower portion of the water spraying unit 9 along the planar member 6 to receive water sprayed from the water spraying unit 9 and to allow water to flow toward the planar member 6.

The water washing unit 9 is a tubular member, for example, and is disposed on the upper portion of the planar member 6. The plurality of holes 9*a* is formed on a tube wall of the water spraying unit 9 along the tube axis direction. Water is sprayed downward from the holes 9*a*.

According to the water washing unit 8 of the present embodiment, water sprayed downward from the plurality of holes 9*a* of the water spraying unit 9 hits the flat plate 10 to be diffused, and then flows toward the planar member 6 of the collecting electrode 3. Therefore, as compared with the case in which water is sprayed directly from the water spraying unit 9 toward the planar member 6 of the collecting electrode 3, water can be made flow equally onto the surface of the planar member 6 of the collecting electrode 3 to form a liquid film, thus allowing the collecting electrode 3 to be washed equally.

Figure 10A:
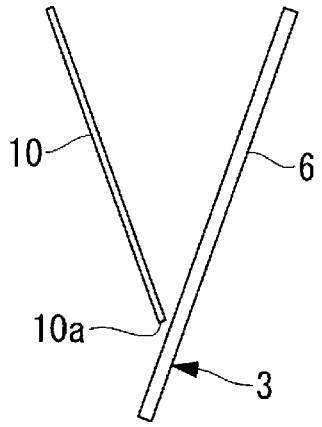
FIG. 10A is a vertical cross-sectional view illustrating a working example of a flat plate of the water washing unit of the dust collector according to the embodiment of the present invention.
Figure 10B:
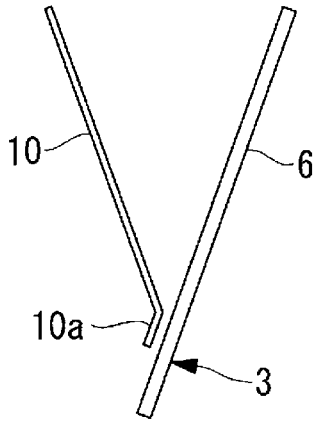
FIG. 10B is a vertical cross-sectional view illustrating a working example of the flat plate of the water washing unit of the dust collector according to the embodiment of the present invention.
Figure 10C:
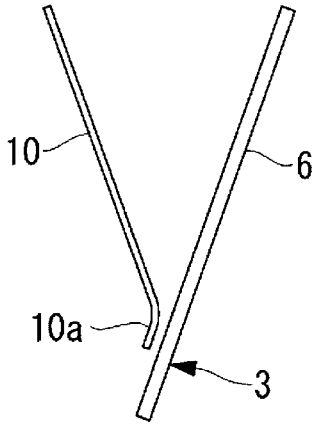
FIG. 10C is a vertical cross-sectional view illustrating a working example of the flat plate of the water washing unit of the dust collector according to the embodiment of the present invention.
Figure 10D:
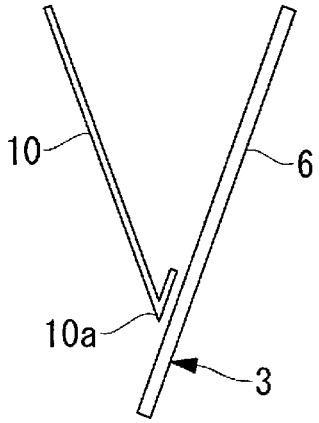
FIG. 10D is a vertical cross-sectional view illustrating a working example of the flat plate of the water washing unit of the dust collector according to the embodiment of the present invention.

Note that an end portion 10*a* of the flat plate 10 on the planar member 6 side may have a linear cross section, as illustrated in FIG. 8 or FIG. 10A, or the end portion 10*a* on the planar member 6 side may be machined to bend downward or upward. FIG. 10 B and FIG. 10C illustrate examples in which the end portion 10*a* is bent downward, and FIG. 10C illustrates an example in which the bent portion is rounded. FIG. 10D illustrates an example in which the end portion 10*a* is bent upward so as to form a weir. Accordingly, water can be made flow more equally toward the planar member 6 of the collecting electrode 3.

Figure 11:
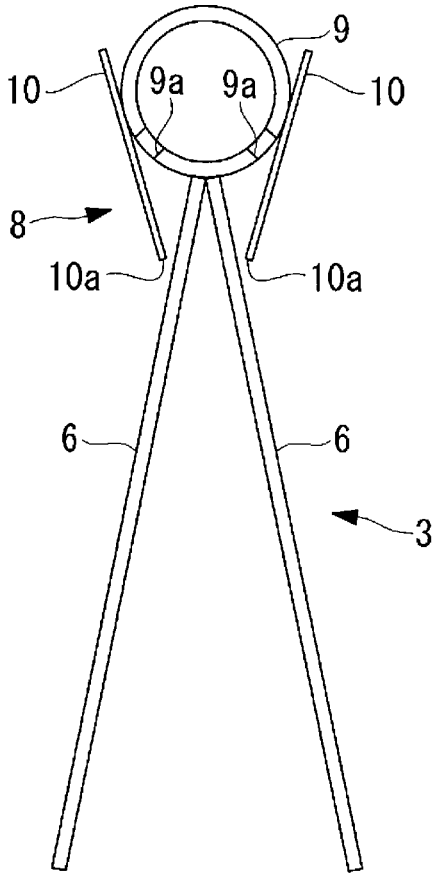
FIG. 11 is a vertical cross-sectional view illustrating a first modified example of the water washing unit of the dust collector according to the embodiment of the present invention.

Moreover, in FIG. 8, the case in which the water spraying unit 9 and the flat plate 10 are disposed on the upper portion of the planar member 6 on one side of the collecting electrode 3 has been described. However, the present invention is not limited to this example. For example, as illustrated in FIG. 11, one water spraying unit 9 may be disposed to be shared in the upper portions of the two planar members 6 of the collecting electrode 3. In this case, two flat plates 10 are disposed for one water spraying unit 9 so as to correspond to the respective two planar members 6. Moreover, at least two rows of holes 9*a* are formed in parallel with each other so as to correspond to the respective flat plates 10. Accordingly, when the electric field forming electrode 24 or the discharge electrode 2 is disposed above the collecting electrode 3, as illustrated in FIG. 3 and FIG. 4, the water spraying unit 9 can be separated from the electric field forming electrode 24 or the discharge electrode 2 disposed above the collecting electrode 3, thus preventing occurrence of discharge between the water spraying unit 9 and the electric field forming electrode 24 or the discharge electrode 2.

Figure 12:
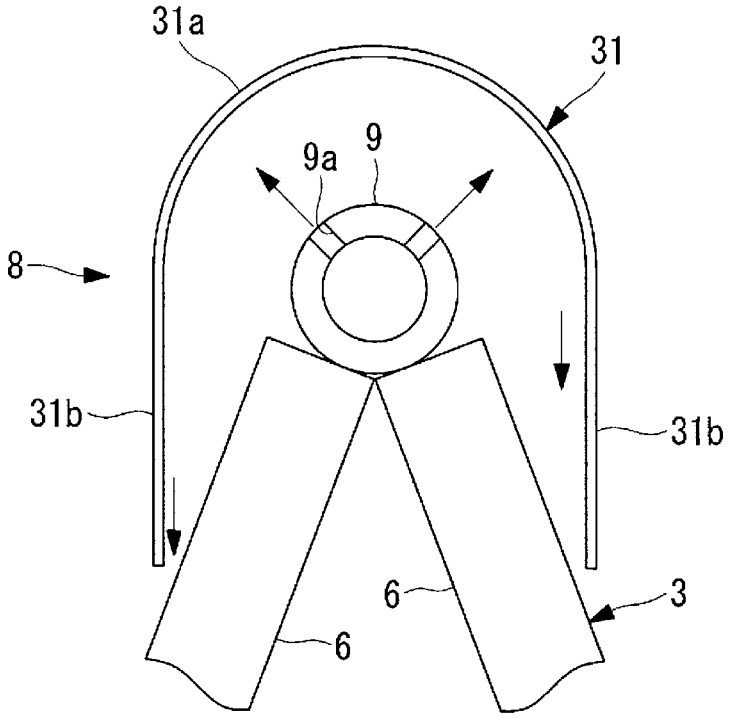
FIG. 12 is a vertical cross-sectional view illustrating a second modified example of the water washing unit of the dust collector according to the embodiment of the present invention.

Moreover, as illustrated in FIG. 12, a running water board 31 may be disposed corresponding to one water spraying unit 9 disposed to be shared on the upper portion of the two planar members 6 of the collecting electrode 3. The running water board 31 is provided above the water spraying unit 9. The upper portion of the running water board 31 is a semi-cylinder 31*a*, and the lower portion thereof is formed of flat plates 31*b* in parallel with each other. According to this water washing unit 8, water sprayed upward from the plurality of holes 9*a* of the water spraying unit 9 hits the semi-cylinder 31*a* of the running water board 31 to be diffused. Thereafter, the water flows on the two flat plates 31*b* forming a liquid film, and then flows toward the planar members 6 of the collecting electrode 3. As a result, similarly to the above-described example, water can be made flow equally onto the surface of the planar members 6 of the collecting electrode 3, thus allowing the collecting electrode 3 to be washed equally. Moreover, the water spraying unit 9 can be separated from the electric field forming electrode 24 or the discharge electrode 2 disposed above the collecting electrode 3, thus preventing occurrence of discharge between the water spraying unit 9 and the electric field forming electrode 24 or the discharge electrode 2.

Note that although the example has been described in which water is sprayed in two upward directions with reference to FIG. 12, the present invention is not limited to this example. For example, two rows of holes may be provided horizontally on the water spraying unit 9 so as to spray water in the horizontal direction, or one row of holes may be provided on the topmost portion of the water spraying unit 9 so as to spray water only in the directly-above direction in order to form a liquid film.

Figure 13:
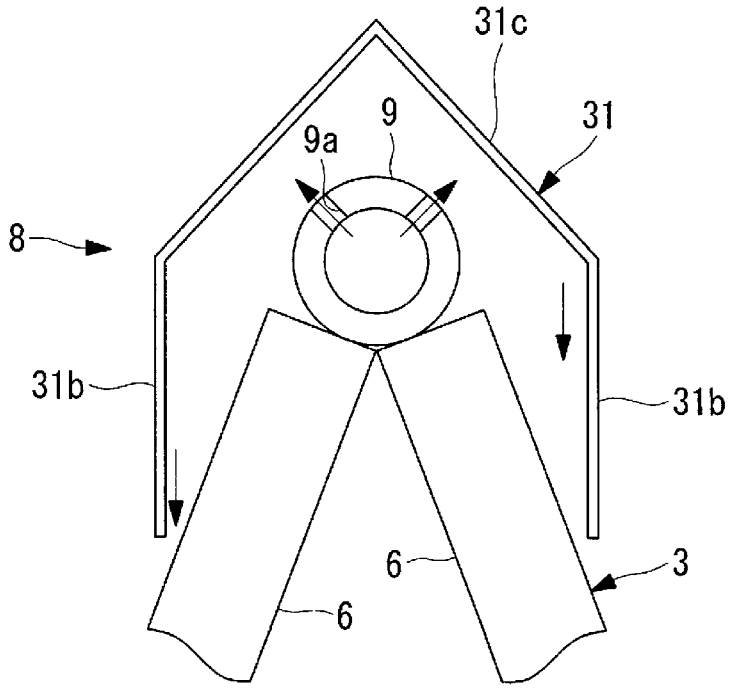
FIG. 13 is a vertical cross-sectional view illustrating a third modified example of the water washing unit of the dust collector according to the embodiment of the present invention.

Moreover, as illustrated in FIG. 13, the upper portion of the running water board 31 may be formed by a bent plate 31*c* and, in this case, the running water board 31 is disposed so that the bent portion of the bent plate 31*c* is positioned at the apex portion.

Furthermore, the two flat plates 31*b* of the running water board 31 do not have to be parallel with each other as long as a liquid film can be guided to the collecting electrode 3, and may be provided to be widened downward, for example. Moreover, the lower end portion of the flat plate 31*b* may be machined to bend inward, for example.

Note that, in the water washing unit 8, the configurations of the discharge electrode 2 and the collecting electrode 3 are not limited to the case of the dust collector 1 having the above-described forms. That is, the discharge electrode 2 and the collecting electrode 3 do not have to be inclined with respect to the gas flow direction, but may be disposed in parallel with the gas flow direction, as illustrated in FIG. 5 and FIG. 6. In this case, the water washing unit 8 is disposed so that the lower end portions of the two flat plates 31*b* of the running water board 31 are positioned on the respective upper ends of the two collecting electrodes 3 in parallel with each other. Accordingly, as compared with the case in which one water spraying unit 9 is provided for each collecting electrode 3, the number of water spraying units 9 to be disposed can be reduced. Moreover, the running water board 31 can block the gas flow and make gas flowing from the upstream side flow toward the collecting electrode 3.

Moreover, the water washing unit 8 may be configured to wash the discharge electrode 2 as well by spraying water from the upstream side in the direction of the gas flow.

Next, an operation method of the water washing unit 8 of the dust collector 1 will be described.

When a plurality of rows of the collecting electrodes 3 and the discharge electrodes 2 are provided, as illustrated in FIG. 1, water washing is performed for every two rows, for example. Note that FIG. 1 illustrates the example in which a water washing unit 11 for washing the filter material 7 is further provided. For example, the water washing units 8A and 8B and the water washing unit 11A start washing at the same time, and the other washing units 8 and 11 stop washing. Then, washing by the water washing unit 8A and the water washing unit 11A is stopped, and washing by the water washing units 8B and 8C and the water washing unit 11B is started next. Here, the other washing units 8 and 11 are kept stopped. Thereafter, washing by the water washing unit 8B and the water washing unit 11B is stopped, and the water washing units 8C and 8D and the water washing unit 11C start washing at the same time. With repetition of such an operation, there is no need to stop the operation of the entire dust collector 1. Moreover, as compared with the case in which water washing is performed in all positions at the same time, a pressure loss of the dust collector 1 can be reduced.

Note that, although FIG. 1 illustrates the case in which one water washing unit 11 is provided for two filter materials 7, one water washing unit 11 may be disposed for one filter material 7.

Figure 14:
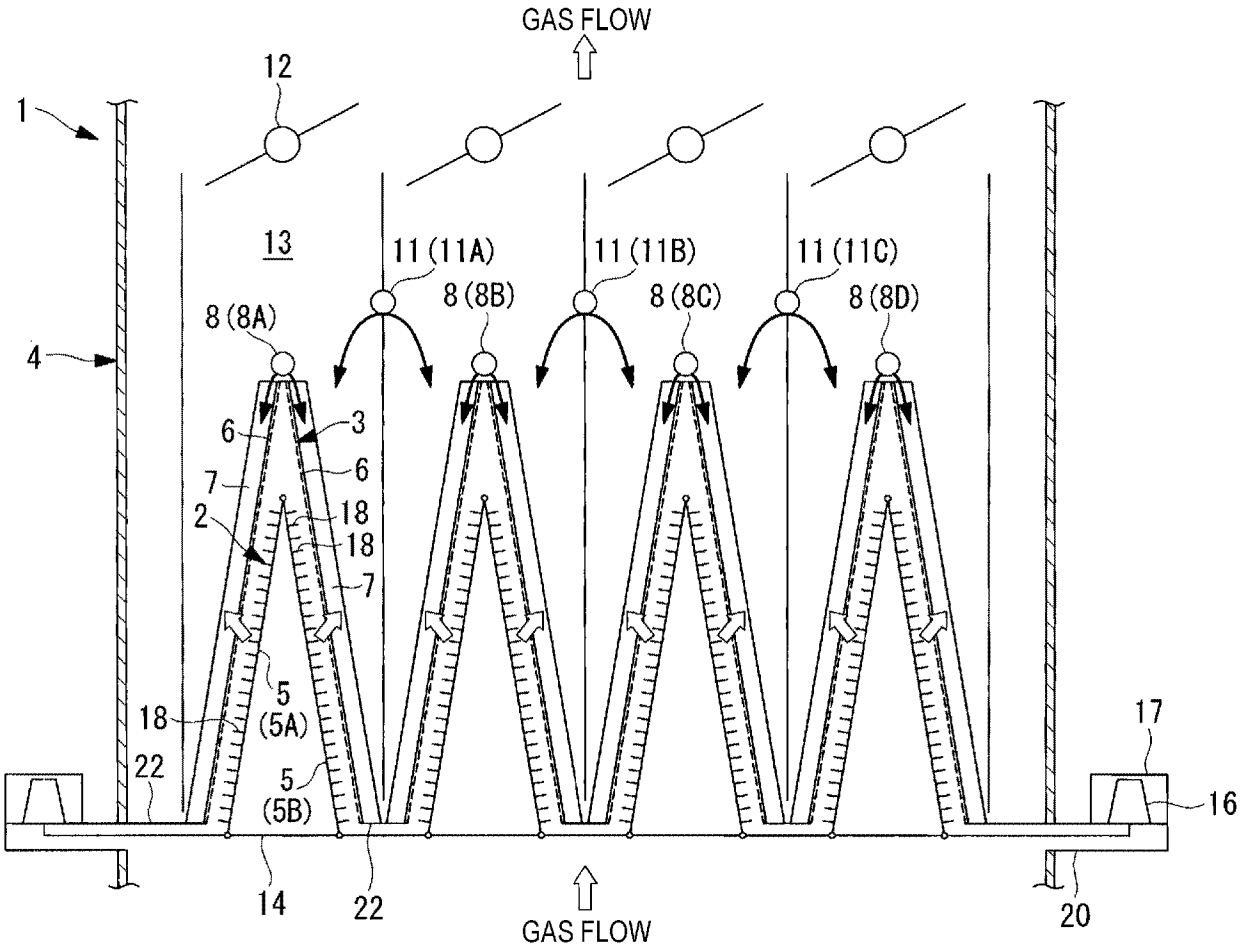
FIG. 14 is a vertical cross-sectional view illustrating a sixth modified example of the dust collector according to the embodiment of the present invention.

Note that although a partition wall or the like is not provided in the casing 4 of the dust collector 1 according to the above-described embodiment, the present invention is not limited to this example. For example, as illustrated in FIG. 14, the dust collector 1 may include therein a plurality of ducts 13 separating, with partitions, each row of the collecting electrode 3 and the discharge electrode 2. Dampers 12 that can be opened and closed are disposed at the outlet of the ducts 13. Then, the operation for closing the damper 12 is performed when the collecting electrode 3 and the discharge electrode 2 are washed. When the damper 12 is closed, the gas does not pass the collecting electrode 3 positioned on the inner side of the closed damper 12. Thus, a liquid film can be formed securely on the surface of the planar member 6 of the collecting electrode 3 in the closed damper 12.

REFERENCE SIGNS LIST

1 Dust collector
2 Discharge electrode
3 Collecting electrode
4 Casing
5 Mounting frame
6 Planar member
7 Filter material
8 Water washing unit
9 Water spraying unit
10 Flat plate (Running water board)
14 Electrode support member
16 Insulator
18 Discharge spike

The invention claimed is:

1. A dust collector comprising:

a casing having an inlet portion into which gas is introduced;

a discharge electrode disposed inside the casing, the discharge electrode having a discharge spike and a mounting frame, which is a linear member, on which the discharge spike is directly disposed, and being configured to have voltage applied thereto; and a collecting electrode disposed inside the casing so as to face the discharge electrode, the collecting electrode having a planar member;

the discharge electrode which has the discharge spike disposed on the mounting frame, being inclined with respect to a gas flow at the inlet portion; and the mounting frame on which the discharge spike is disposed, being connected on a downstream side of the gas flow, and being disposed so that, in the mounting frame, an upstream side of the gas flow is wider than the downstream side of the gas flow;

wherein the planar member of the collecting electrode is inclined with respect to the gas flow at the inlet portion so as to face the mounting frame on which the discharge spike is disposed, and the collecting electrode is a plurality of collecting electrodes connected on a downstream side of the gas flow and disposed so that an upstream side of the gas flow is wider than the downstream side of the gas flow.

2. A dust collector comprising:

a casing having an inlet portion into which gas is introduced;

a discharge electrode disposed inside the casing, the discharge electrode having a discharge spike and a mounting frame for supporting the discharge spike and being configured to have voltage applied thereto; and a collecting electrode disposed inside the casing so as to face the discharge electrode, the collecting electrode having a planar member;

the mounting frame being inclined with respect to a gas flow at the inlet portion; and the mounting frame on which the discharge spike is disposed, being connected on a downstream side of the gas flow, and being disposed so that, in the mounting frame an upstream side of the gas flow is wider than the downstream side of the gas flow; and the dust collector further comprising:

a plurality of water spraying units provided along the planar member of the collecting electrode, the water spraying units being configured to spray water; and a running water board provided in a periphery of the water spraying unit along the planar member, the running water board configured to receive the water sprayed from the water spraying unit and to allow the water to flow toward the planar member.

3. The dust collector according to claim 1, further comprising a filter material disposed on a surface side of the collecting electrode opposite to a surface facing the discharge electrode of the collecting electrode.

4. The dust collector according to claim 3, further comprising an electric field forming electrode disposed separated from the filter material and disposed on a surface side of the filter material opposite to a surface of the filter material having the collecting electrode provided thereon.

5. The dust collector according to claim 1, wherein the discharge electrode is disposed on both surface sides of the collecting electrode.

6. A dust collection system comprising a plurality of stages of the dust collector described in claim 1, disposed in series along the gas flow.

7. A dust collector comprising:

a discharge electrode configured to have voltage applied thereto;

a collecting electrode disposed facing the discharge electrode, the collecting electrode having a planar member formed of a wire mesh;

a plurality of water spraying units provided along the planar member of the collecting electrode, the water spraying units being configured to spray water; and a running water board provided in a periphery of the water spraying unit along the planar member, the running water board being configured to receive the water sprayed from the water spraying units and to allow the water to flow toward the planar member.

8. A dust collection method comprising the step of:

collecting particulate material using a dust collector, the dust collector including:

a casing having an inlet portion into which gas is introduced;

a discharge electrode disposed inside the casing, the discharge electrode having a discharge spike and a mounting frame, which is a linear member, on which the discharge spike is directly disposed, and being configured to have voltage applied thereto; and a collecting electrode disposed inside the casing so as to face the discharge electrode, the collecting electrode having a planar member;

the discharge electrode which has the discharge spike disposed on the mounting frame, being inclined with respect to a gas flow at the inlet portion; and the mounting frame on which the discharge spike is disposed, being connected on a downstream side of the gas flow, and being disposed so that, in the mounting frame an upstream side of the gas flow is wider than the downstream side of the gas flow;

wherein the planar member of the collecting electrode is inclined with respect to the gas flow at the inlet portion so as to face the mounting frame on which the discharge spike is disposed, and the collecting electrode is a plurality of collecting electrodes connected on a downstream side of the gas flow and disposed so that an upstream side of the gas flow is wider than the downstream side of the gas flow.

9. The dust collector according to claim 1, wherein the mounting frame includes two mounting frame portions arranged such that an upstream side of the gas flow is widened and a downstream side of the gas flow is connected together.

* * * * *